US007610938B2

(12) United States Patent
Yanokura et al.

(10) Patent No.: US 7,610,938 B2
(45) Date of Patent: Nov. 3, 2009

(54) CYLINDRICAL ROD AND METHOD FOR MANUFACTURING THE SAME

(75) Inventors: Itaru Yanokura, Suwa (JP); Hiroshi Hashizume, Suwa (JP); Norio Nomura, Suwa (JP); Nagamitsu Takashima, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/856,444

(22) Filed: Sep. 17, 2007

(65) Prior Publication Data

US 2008/0121008 A1 May 29, 2008

Related U.S. Application Data

(63) Continuation of application No. PCT/JP2006/304294, filed on Mar. 6, 2006.

(30) Foreign Application Priority Data

Mar. 17, 2005 (JP) ..... 2005-077574
Feb. 21, 2006 (JP) ..... 2006-043955

(51) Int. Cl.
*F16L 9/00* (2006.01)

(52) U.S. Cl. ..... 138/170; 138/168; 138/165; 138/169

(58) Field of Classification Search ..... 138/168, 138/170, 171, 169, 165
See application file for complete search history.

(56) References Cited

U.S. PATENT DOCUMENTS 556,819 A * 3/1896 Hartman ..... 138/156
595,035 A * 12/1897 Beranger et al ..... 403/235
1,863,873 A * 6/1932 Quarnstrom ..... 228/146
1,999,818 A * 4/1935 Mcintyre ..... 228/144
2,202,909 A * 6/1940 Hufferd et. al. ..... 74/579 R
2,317,198 A * 4/1943 Kasper ..... 72/51
2,362,817 A * 11/1944 Haycock ..... 413/1
3,050,649 A * 8/1962 Thomasko ..... 310/247
3,099,238 A * 7/1963 Jones ..... 228/137
3,301,992 A * 1/1967 Seeloff ..... 219/105
3,543,227 A * 11/1970 Moulin ..... 439/847
4,490,422 A * 12/1984 Pascher ..... 428/35.1
4,907,626 A 3/1990 Mori
5,001,816 A * 3/1991 Oetiker ..... 24/20 EE (Continued)

FOREIGN PATENT DOCUMENTS

JP 55-43360 A 3/1980

(Continued)

*Primary Examiner*—James F Hook
(74) *Attorney, Agent, or Firm*—Sughrue Mion, PLLC

(57) ABSTRACT

A cylindrical rod 20 is formed by bending sheet metal 10 so as to bond together a pair of edges 12 and 14 of the sheet metal 10. The cylindrical rod 20 includes therein (i) convex portions 16 each of which protrudes from the edge 12 and includes a sub-portion whose width is larger at a side thereof more distant from the edge 12 than at a side thereof less distant from the edge 12, and (ii) concave portions 18 which are formed on the edge 14, have a shape complementary to the shape of the convex portions 16, and are fitted into the convex portions 16. A cylindrical rod which has high circularity and high linearity, in other words, which hardly has vertical and horizontal curves can be provided.

11 Claims, 11 Drawing Sheets

U.S. PATENT DOCUMENTS

| | | | | |
|---|---|---|---|---|
| 6,391,414 | B1 * | 5/2002 | Hjertman et al. | 428/36.9 |
| 6,634,076 | B2 * | 10/2003 | Hjertman et al. | 29/521 |
| 2004/0140011 | A1 * | 7/2004 | Kondou et al. | 138/167 |
| 2007/0131015 | A1 * | 6/2007 | Matsumura et al. | 72/368 |

FOREIGN PATENT DOCUMENTS

| | | | |
|---|---|---|---|
| JP | 11-156440 | A | 6/1999 |
| JP | 2004-1003 | A | 1/2004 |

* cited by examiner

CYLINDRICAL ROD AND METHOD FOR MANUFACTURING THE SAME

CROSS REFERENCE TO RELATED APPLICATION

This is a continuation application of PCT/JP2006/304294 filed on Mar. 6, 2006 which claims priority from a Japanese Patent Applications NO. 2005-077574 filed on Mar. 17, 2005, and NO. 2006-043955 filed on Feb. 21, 2006, the contents of which are incorporated herein by reference

BACKGROUND

1. Technical Field

The present invention relates to a cylindrical rod. More particularly, the present invention relates to a cylindrical rod which is manufactured by bending sheet metal, and a method for manufacturing the same.

2. Related Art

A number of techniques have been developed to manufacture cylindrical products by bending sheet metal. One of those techniques is disclosed in Unexamined Japanese Patent Application Publication No. 2003-245721. According to the technique disclosed in this publication, relatively thin sheet matal is bent so that a tube with a small diameter is manufactured. In more detail, the above-mentioned publication suggests using a core roll that has substantially the same internal diameter as a target cylindrical product, a pair of pressing rolls that are pressed against the core roll so as to rotate together with the core roll, and a guide belt that is provided so as to connect the respective rolls and to form a unique path. With these rolls and guide belt, the sheet metal is shaped while being in a tight contact with the core roll. The above-mentioned publication explains that this technique enables the sheet metal to be shaped without causing barrel-like deformation.

Such cylindrical products may be desired to be utilized in place of solid metal round bars having a small diameter which are manufactured by means of the cutting technique, for the purpose of lowering the cost, for example. However, no cylindrical rod products have been developed which have satisfactory quality in terms of the characteristics such as the circularity of the circumference and the linearity in the axis direction.

SUMMARY

An advantage of one aspect of the present invention is to provide a cylindrical rod which is capable of solving the above-mentioned problems and a method for manufacturing the same. This advantage is achieved by combining the features recited in the independent claims. The dependent claims define further effective specific example of the present invention.

In view of the above, a first embodiment of the present invention provides a cylindrical rod which is formed by bonding together a pair of opposing edges of sheet metal. Here, each of the opposing edges has (i) convex portions each of which protrudes from the edge and includes a sub-portion whose width is larger at a side thereof more distant from the edge than at a side thereof less distant from the edge, and (ii) concave portions each of which dents from the edge and includes a sub-portion whose width is larger at a side thereof more distant from the edge than at a side thereof less distant from the edge, and the convex portions and the concave portions of one of the opposing edges are fitted into the concave portions and the convex portions of the other of the opposing edges. With such a configuration, the spring back of the sheet metal does not cause the bonded edges to be detached from each other, and the shape of the cylindrical rod is maintained without a bonding step performed by techniques including welding. In addition, since the sheet metal subjected to the bending process has a long developed length, the bending process can be performed excellently.

According to an embodiment, the cylindrical rod has a linear section which forms substantially a right angle with respect to each of the opposing edges, and the linear section is adjacent to the edge. With such a configuration, the linear sections of the concave and convex portions are brought into contact with each other, so as to improve the torsional rigidity of the cylindrical rod.

According to another embodiment, the linear sections are arranged at equal intervals in a longitudinal direction of the cylindrical rod. With such a configuration, the cylindrical rod can have uniform physical characteristics along the entire length. As a result, local deformation can be prevented.

According to another embodiment the linear section is formed on the same side in each of the convex and concave portions in a longitudinal direction of the cylindrical rod. With such a configuration, the concave and convex portions can be also arranged at equal intervals. Therefore, the cylindrical rod can have even more uniform physical characteristics. As a result, the cylindrical rod can have uniform physical characteristics along the entire length, thereby preventing local deformation more effectively.

According to another embodiment, a plurality of notches which extend in a direction along a circumference of the cylindrical rod are provided so as to be adjacent to each other in an axis direction. With such a configuration, the stresses generated in the axis direction of the cylindrical rod are alleviated, and the cylindrical rod is prevented from being deformed, for example, curved.

According to another embodiment, the plurality of notches are positioned at the convex and concave portions. With such a configuration, the stresses generated by the fitted convex and concave portions are alleviated, so as to maintain the linearity in the axis direction.

According to another embodiment, the plurality of notches are positioned between the convex and concave portions in the axis direction. With such a configuration, the residual stresses in the entire cylindrical rod are alleviated, so as to maintain the linearity in the axis direction.

According to a second embodiment of the present invention, the plurality of notches which extend in the direction along the circumference of the cylindrical rod are provided on an internal surface of the cylindrical rod so as to be adjacent to each other in the axis direction in the cylindrical rod. With such a configuration, the cylindrical rod has a smooth surface, and can be similarly treated to a solid round bar member.

According to another embodiment, a plurality of notches which extend in the axis direction are additionally provided in the cylindrical rod. With such a configuration, the residual stresses in the direction along the circumference of the cylindrical rod can be alleviated, so as to maintain high circularity.

A third embodiment of the present invention provides a manufacturing method for manufacturing a cylindrical rod by bending sheet metal so as to bond together a pair of opposing edges of the sheet metal. Here, the cylindrical rod is characterized in that each of cross-sections which are perpendicular to a longitudinal direction of the cylindrical rod has a circular shape. The manufacturing method sequentially includes a preparing step of forming the sheet metal in which each of the opposing edges has (i) convex portions each of which protrudes from the edge and includes a sub-portion whose width is larger at a side thereof more distant from the edge than at a side thereof less distant from the edge, and (ii) concave portions each of which dents from the edge and includes a sub-portion whose width is larger at a side thereof more distant from the edge than at a side thereof less distant from the edge, a preliminary step of bending the sheet metal in such a manner that, when seen in each of the cross-sections which are perpendicular to the longitudinal direction of the cylindrical rod, portions of the sheet metal in a vicinity of respective edges of the sheet metal excluding the convex portions form arcs, an intermediate step of bending the sheet metal in such a manner that when seen in each of the cross-sections which are perpendicular to the longitudinal direction of the cylindrical rod, a portion of the sheet metal in a vicinity of a middle of the sheet metal is shaped like an arc, and a completing step of bending the sheet metal across an entire width thereof in such a manner that, when seen in the cross-sections which are perpendicular to the longitudinal direction of the cylindrical rod, the sheet metal forms a circle, and fitting the convex portions and the concave portions to each other. With such a manufacturing method, the convex and concave portions having varying width are smoothly fitted to each other. The manufactured cylindrical rod is not deformed again by the spring back, and can maintain the shape without requiring a bonding step performed by using techniques including welding.

According to another embodiment, the convex portions and the concave portions are fitted to each other after the edges of the sheet metal are brought close to each other in the step of bending the sheet metal so as to bond together the pair of edges in the manufacturing method. In this way, THE wide sections of the convex portions and the narrow sections of the concave portions are prevented from interfering with each other during the process in which the edges of the sheet metal are bonded to each other. As a result, the sheet metal is prevented from being deformed.

Here, all the necessary features of the present invention are not listed in the summary. The sub-combinations of the features may become the invention.

DESCRIPTION OF EXEMPLARY EMBODIMENTS

Hereinafter, some aspects of the present invention will be described through embodiments. The embodiments do not limit the invention according to the claims, and all the combinations of the features described in the embodiments are not necessarily essential to means provided by aspects of the invention.

Figure 1:
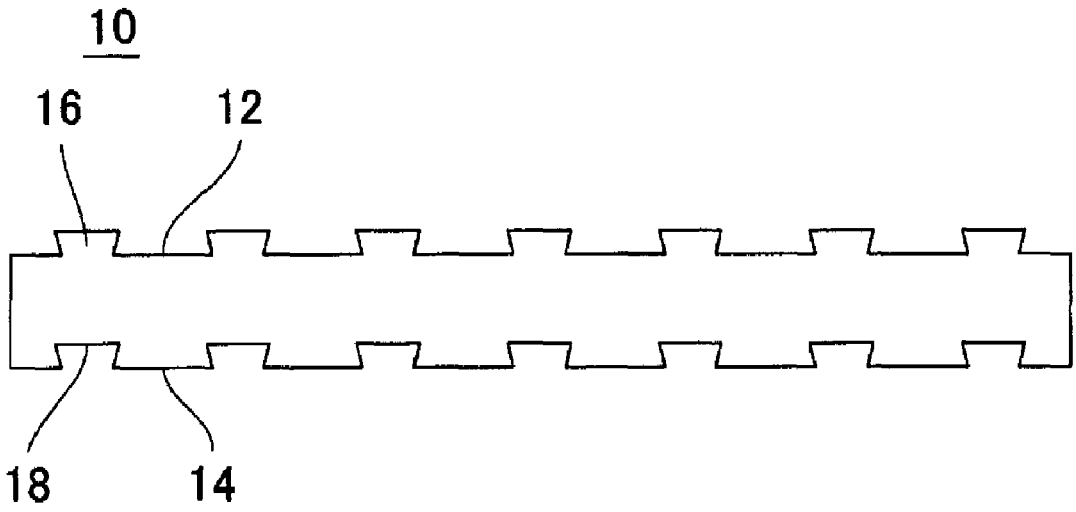
FIG. 1 illustrates the shape of sheet metal 10 which is a raw material of a cylindrical rod 20 relating to the present invention.

FIG. 1 illustrates the shape of sheet metal 10 which is a raw material of a cylindrical rod 20 relating to the present invention. As illustrated in FIG. 1, the sheet metal 10 has a rectangular shape as a whole, and is bent in such a manner that a pair of opposing edges 12 and 14, which are longer sides of the rectangle, become in contact with each other. In this way, the cylindrical rod 20 is formed and the longitudinal direction of the cylindrical rod 20 is considered to be the axis direction. Here, the sheet metal 10 is 314 mm in the longitudinal direction and has a length of 10 mm from the edge 12 to the edge 14.

On the edge 12 of the sheet metal 10, a plurality of convex portions 16 are provided at intervals. The convex portions 16 protrude from the edge 12. On the edge 14, a plurality of concave portions 18 are formed at intervals. The concave portions 18 have a depth extending from the edge 14 towards the edge 12. In addition, each of the convex portions 16 is arranged at the same position as a corresponding one of the concave portions 18 with respect to the longitudinal direction of the sheet metal 10.

Figure 2:
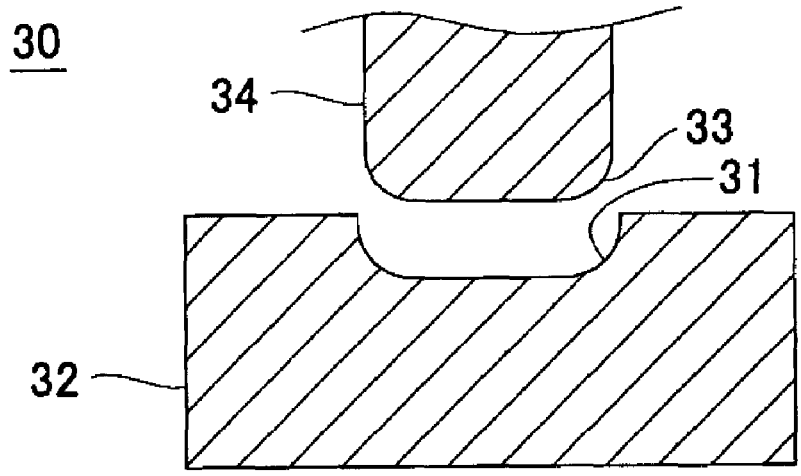
FIG. 2 is a cross-sectional view illustrating a tool 30 which is used in the initial bending process to be performed on the sheet metal 10.

FIG. 2 illustrates the shape of a tool 30 which is used in the initial bending process to be performed on the sheet metal 10. As illustrated in FIG. 2, the tool 30 includes a die 32 and a punch 34 which have processing surfaces 31 and 33. The processing surfaces 31 and 33 have shapes complementary to each other. The processing surfaces of the die 32 and punch 34 are flat in the middle portion thereof, and have a cross-sectional shape like an arc of approximately 90 degrees at the respective edges.

The tool 30 extends in a direction perpendicular to the plane containing therein the sheet of paper on which FIG. 2 is shown, with the cross-sectional shape illustrated in FIG. 2 being maintained. The processing surfaces of the die 32 and punch 34 are the same in width as the sheet metal 10 when the convex portions 16 and concave portions 18 are ignored. Here, the sheet metal 10 is inserted into the tool 30 having the above-described configuration in such a manner that the longitudinal direction of the sheet metal 10 matches the direction perpendicular to the plane containing therein the sheet of paper on which FIG. 2 is shown.

Figure 3:
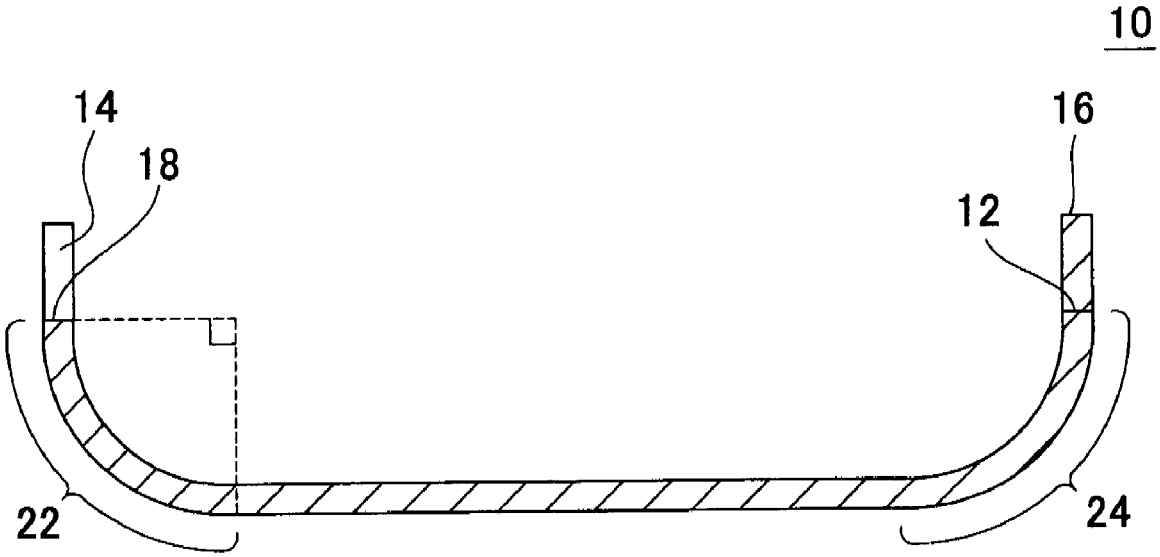
FIG. 3 illustrates the cross-sectional shape of the sheet metal 10 which is observed after the bending process is performed on the sheet metal 10 by using the tool 30 illustrated in FIG. 2.

FIG. 3 illustrates the cross-sectional shape of the sheet metal 10 which is observed after the sheet metal 10 is bent by using the tool 30 illustrated in FIG. 2. As illustrated in FIG. 3, the respective edges of the sheet metal 10 extending in the longitudinal direction are bent, so as to form bent portions 22 and 24 which have a cross-sectional shape like an arc with the central angle of approximately 90 degrees. Since the processing surfaces of the die 32 and punch 34 have sizes determined in correspondence with the size of the entire sheet metal 10 as previously mentioned, both of the edges of the sheet metal 10 are bent so as to form an arc-like cross-section, except for the portions in the vicinity of the convex portions 16 and concave portions 18.

Figure 4:
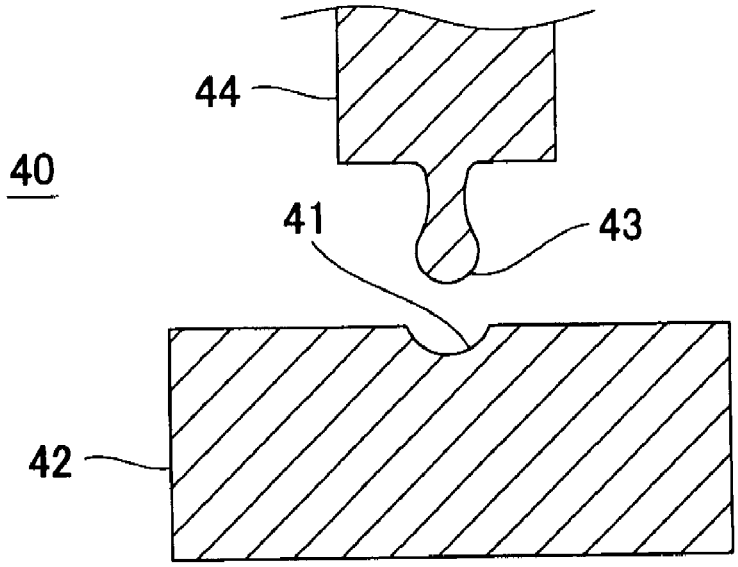
FIG. 4 is a cross-sectional view illustrating a tool 40 which is used in the next bending process to be performed on the sheet metal 10.

FIG. 4 illustrates the shape of a tool 40 which is used in the next bending process to be performed on the sheet metal 10 illustrated in FIG. 3. As illustrated in FIG. 4, the tool 40 includes a die 42 and a punch 44. To be more specific, the die 42 has therein a processing surface 41 with an arc-like cross-section that is open at the upper side thereof. On the other hand, the punch 44 has, at the lower end thereof, a processing surface 43 with an arc-like cross-section. In addition, a space 45 is provided over the processing surface 43 to avoid the edges 12 and 14 of the sheet metal 10 which go upwards as a result of the bending process.

Figure 5:
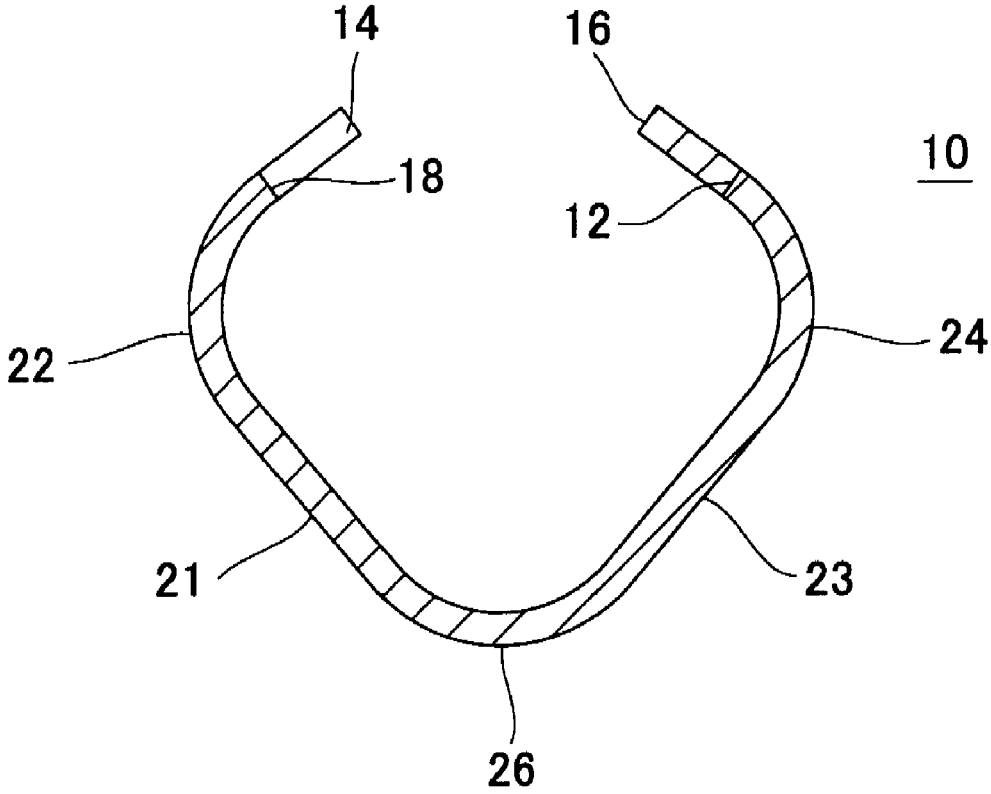
FIG. 5 illustrates the cross-sectional shape of the sheet metal 10 which is observed after the bending process is performed on the sheet metal 10 by using the tool 40 illustrated in FIG. 4.

FIG. 5 illustrates the cross-sectional shape of the sheet metal 10 which is observed after the sheet metal 10 is bent by using the tool 40 illustrated in FIG. 4. As illustrated in FIG. 5, the sheet metal 10 is inserted into the tool 40, and then bent so that the middle of the distance from the edge 14 of the sheet metal 10 to the edges of the convex portions 16 coincides with the middle points of the processing surfaces 41 and 43 of the tool 40.

As a result of the above bending process, a bent portion 26 with an arc-like cross-section is similarly formed, in addition to the bent portions 22 and 24 which are formed by the bending process using the tool 30 and have an arc-like cross-section. Here, not-bent portions 21 and 23 are left between the bent portions 22 and 26, and between the bent portions 24 and 26.

Figure 6:
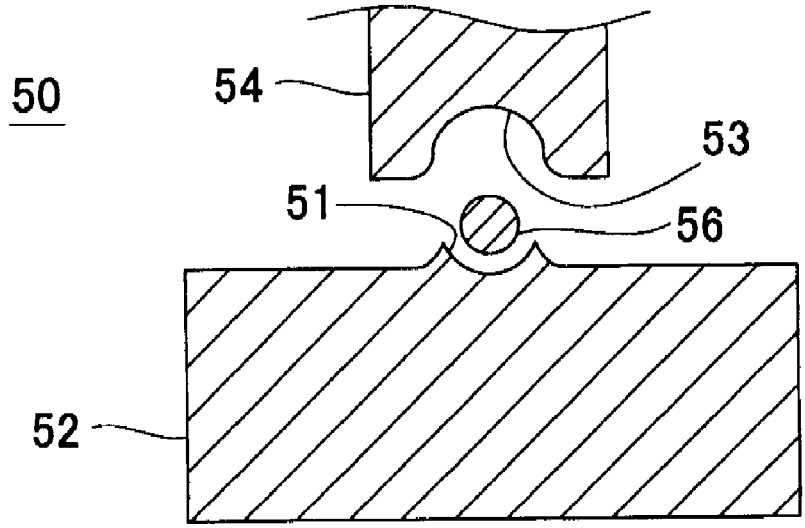
FIG. 6 is a cross-sectional view illustrating a tool 50 which is used in the last bending process to be performed on the sheet metal 10.

FIG. 6 illustrates the shape of a tool 50 which is used in the last bending process to be performed on the sheet metal 10 illustrated in FIG. 5. As illustrated in FIG. 6, the tool 50 includes a die 52, a punch 54 and a core die 56. The die 52 has therein a processing surface 51 with an arc-like cross-sectional shape, which is formed so as to slightly protrude from the upper surface of the die 52. On the other hand, the punch 54 has a processing surface 53 similarly with an arc-like cross-sectional shape, which is positioned upper than the lower end surface of the punch 54.

The side portions surrounding the processing surface 51 have shapes complementary to the shape of the end portion of the punch 54 excluding the processing surface 53. The tool 50 is configured in such a manner that when the punch 54 is moved downward, the side portions surrounding the processing surface 51 does not come into a contact with the end portion of the punch 54 excluding the processing surface 53. The core die 56 is a round bar having an outer diameter which is substantially the same as the internal diameter of the cylindrical rod 20 (the final product). When used, the core die 56 is placed within the sheet metal 10 which has been bent by using the tool 40.

The sheet metal 10 which has been bent by using the tool 40 is inserted into the die 52 of the tool 50 having the above-described configuration, so that the external side of the bent portion 26 becomes in contact with the internal side of the processing surface 51. After this, the core die 56 is placed within the sheet metal 10.

With the sheet metal 10 being set within the tool 50 as described above, the punch 54 is moved down. As a result, the edge 14 of the sheet metal 10 comes close to the edge 12 having the convex portions 16, so that the convex portions 16 are fitted into the concave portions 18. Following this, the punch 54 is further pressed down, so that the portions in the vicinity of the edges 12 and 14 containing the convex portions 16 and concave portions 18 are shaped into an arc as a whole, between the processing surface 53 of the punch 54 and the core die 56.

At the same time, the sheet metal 10 containing the not-bent portions 21 and 23 is bent between the lower portion of the core die 56 and the processing surface 51 of the die 52. Therefore, the bending process by using the tool 50 shapes the sheet metal 10 into a hollow cylinder having a ring-like cross-section as a whole. Note that the above-described sheet metal 10 is formed into the cylindrical rod 20 which has an outer diameter of approximately 5 mm.

Figure 7:
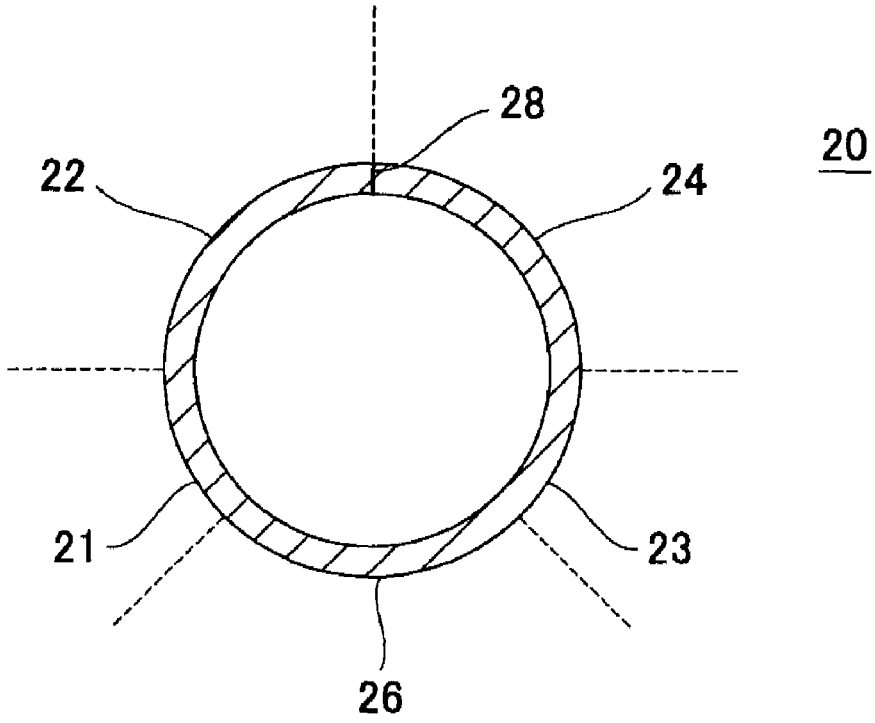
FIG. 7 illustrates the cross-sectional shape of the sheet metal 10 which is observed after the sheet metal 10 has been formed into the cylindrical rod 20.

FIG. 7 illustrates the cross-sectional shape of the cylindrical rod 20 which is manufactured by using the tool 50 illustrated in FIG. 6. As illustrated in FIG. 7, the series of bending processes performed by using the tools 30, 40 and 50 bends the entire sheet metal 10 at a uniform bending rate, thereby producing the cylindrical rod 20. It should be noted here that the entire sheet metal 10 is bent at the same bending rate, including the convex portions 16. Therefore, the manufactured cylindrical rod 20 has high circularity.

During the process in which the sheet metal 10 having the cross-sectional shape illustrated in the FIG. 5 is processed so as to have the cross-sectional shape illustrated in FIG. 7, the convex portions 16 and concave portions 18 are fitted into each other. Here, if the wide sections of the convex portions 16 are inserted into the narrow sections of the concave portions 18, the sheet metal 10 may suffer from incorrect deformation. To avoid this, it is necessary to carefully determine the shape of the processing surface 53 of the punch 54 so that the convex portions 16 and concave portions 18 are smoothly fitted into each other. To be specific, the edges 12 and 14 are brought close to each other while the tangential lines of the edges 12 and 14 are kept in such a state as to intersect with each other when seen at each of the cross-sections of the cylindrical rod 20 which are perpendicular to the longitudinal direction of the cylindrical rod 20. In this way, the wide sections of the convex portions 16 are caused to pass through the wide sections of the concave portion 18. The above-described method makes it possible to process the sheet metal 10 smoothly, and prevents the sheet metal 10 from being incorrectly deformed.

Figure 8:
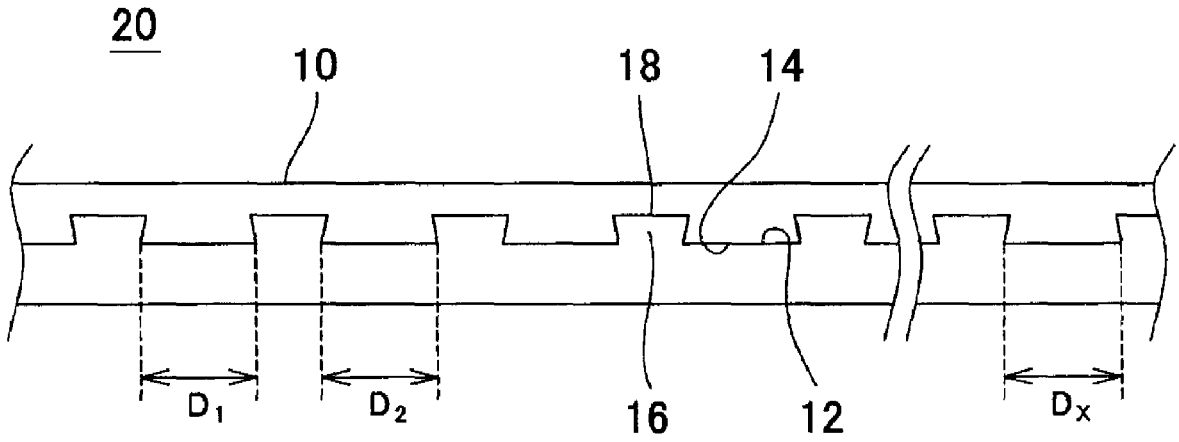
FIG. 8 illustrates the bonding portion of the cylindrical rod 20 and how concave portions 18 and convex portions 16 are arranged.

FIG. 8 illustrates the bonding portion of the cylindrical rod 20. As illustrated in FIG. 8, the edges 12 and 14 are in tight contact with each other. Also, the convex portions 16 and concave portions 18 are fitted into each other. In addition, the intervals ($D_1$ to $D_X$) between the convex portions 16 are the same over the entire length of the cylindrical rod 20.

Figure 9:
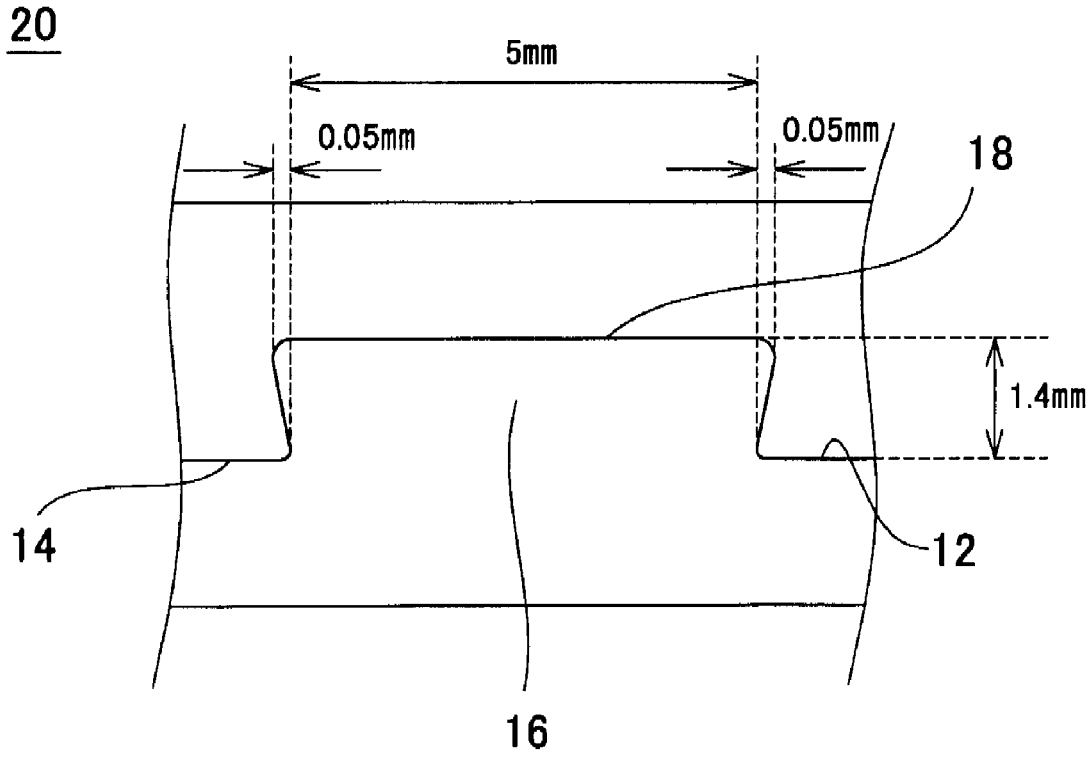
FIG. 9 illustrates the bonding portion of the cylindrical rod 20 in the enlarged state.

FIG. 9 illustrates, in the enlarged state, how the convex portions 16 and concave portions 18 are fitted into each other in the cylindrical rod 20 illustrated in FIG. 8. As illustrated in FIG. 9, the convex portions 16 have such a shape that the width is larger at the edge than at the root. On the other hand, the concave portions 18 have such a shape that the width is smaller at the side closer to the edge 14 than at the side further from the edge 14. With such a configuration, the fitted convex portions 16 and concave portions 18 are prevented from being disconnected from each other even when the spring back caused by the elasticity of the sheet metal 10 creates a force extending in the direction along the circumference of the cylindrical rod 20. For this reason, the cylindrical rod 20 can be directly used as a shaft product without welding, adhering and/or other processes.

The convex portions 16 and concave portions 18 may have any shapes, as long as the convex portions 16 and concave portions 18 have portions therein which are capable of withstanding the spring back. This is explained in detail. For example, when the convex portions 16 have a very large width in the longitudinal direction of the cylindrical rod 20, the fitted convex portions 16 and concave portions 18 may be disconnected from each other by the buckling of the convex portions 16 in the longitudinal direction of the cylindrical rod 20. In this case, the strength of the convex portions 16 may be enhanced by increasing the length of a portion of each convex portion 16 which is in the vicinity of the middle in the longitudinal direction of the cylindrical rod 20. Alternatively, the sheet metal which is used as the raw material may be sharply bent so that the stresses are easily concentrated. Therefore, the sheet metal may be sharply bent in such a manner as to form a smooth shape as a whole. Alternatively, under the condition that each convex portion 16 has, in at least a portion thereof, such a shape that the width is larger at the edge than at the root and each concave portion 18 has a shape complementary to the shape of the convex portion 16, each convex portion 16 may have a different shape in the remaining portion. For example, the convex portions 16 may each include a substantially disk-like portion and a connecting portion that connects part of the circumference of the disk to the sheet metal 10.

According to the exemplary embodiment shown in FIG. 9, the opening width of each concave portion 18 at the edge 14 is 5 mm, and the height of each convex portion 16 (in other words, the depth of each concave portion 18) is 1.4 mm as written in the drawing. The width of each convex portion 16 is larger by 0.05 mm on each of the left and right sides at the edge than at the root (in other words, the width of each concave portion 18 is larger by 0.05 mm on each of the left and right sides at the bottom than at the opening.)

As described in the above section, the bending process can manufacture a cylindrical rod having high circularity, by repeating a bending step with a reduced amount of bending. In addition, the cylindrical shape can be obtained only by means of the bending process, without the bonding process performed based on welding, adhering or the like and can be maintained, by forming complementary concave portions and convex portions at the edges of the sheet metal that is subjected to the bending process and fitting the formed concave portions and convex portions to each other.

Figure 10:
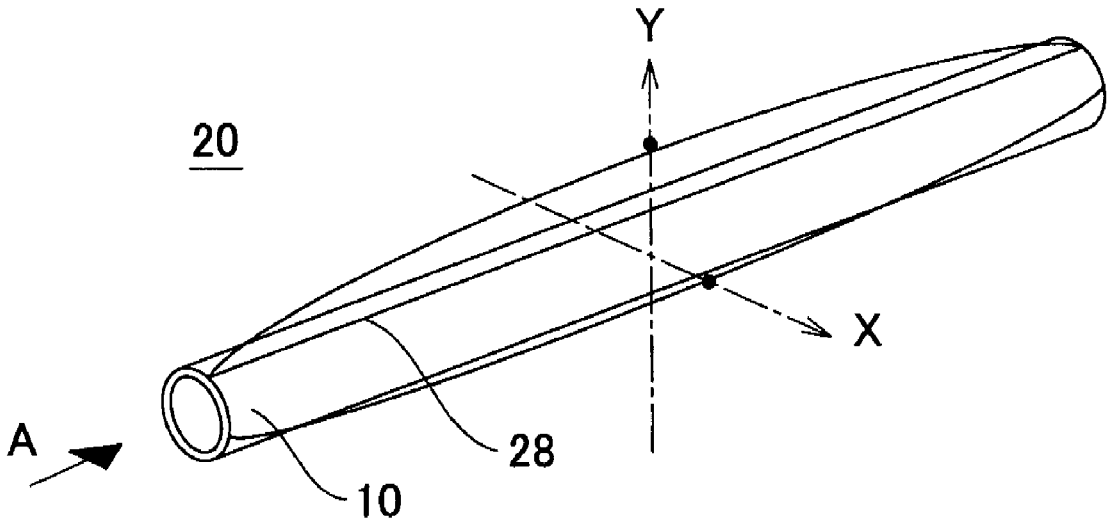
FIG. 10 schematically illustrates the curve of the cylindrical rod 20.

FIG. 10 schematically illustrates the curve of the above-described cylindrical rod 20. As illustrated in FIG. 10, it is assumed that the bonding portion 28 of the sheet metal 10 is positioned on the upper side and that there is an X-Y coordinate system which intersects with the axis direction of the cylindrical rod 20 at night angles. Under these assumptions, the middle point of the cylindrical rod 20 in the longitudinal direction of the cylindrical rod 20 may be displaced in the Y axis direction (the vertical curve) or in the X direction (the horizontal curve).

Figure 11:
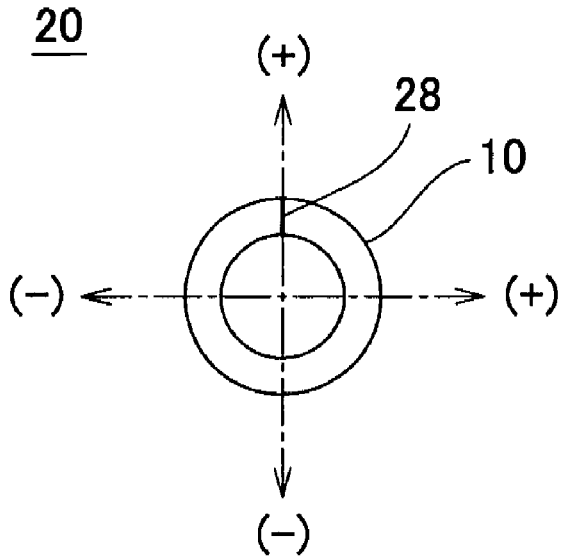
FIG. 11 illustrates, in a cross-sectional manner, the direction in which the cylindrical rod 20 is curved.

FIG. 11 illustrates the directions of the above-mentioned vertical and horizontal curves, in terms of the cross-section of the cylindrical rod 20 which is perpendicular to the arrow line A in FIG. 10. As indicated in FIG. 11, the positive values are plotted in the upper or right section. However, the amount of curve preferably has a small absolute value, irrespectively of whether the amount has a positive or negative value. In other words, when the cylindrical rod 20 has high circularity as explained above but has large curve, the cylindrical rod 20 is not suitable, particularly, for being used as a rotation axis.

Figure 12:
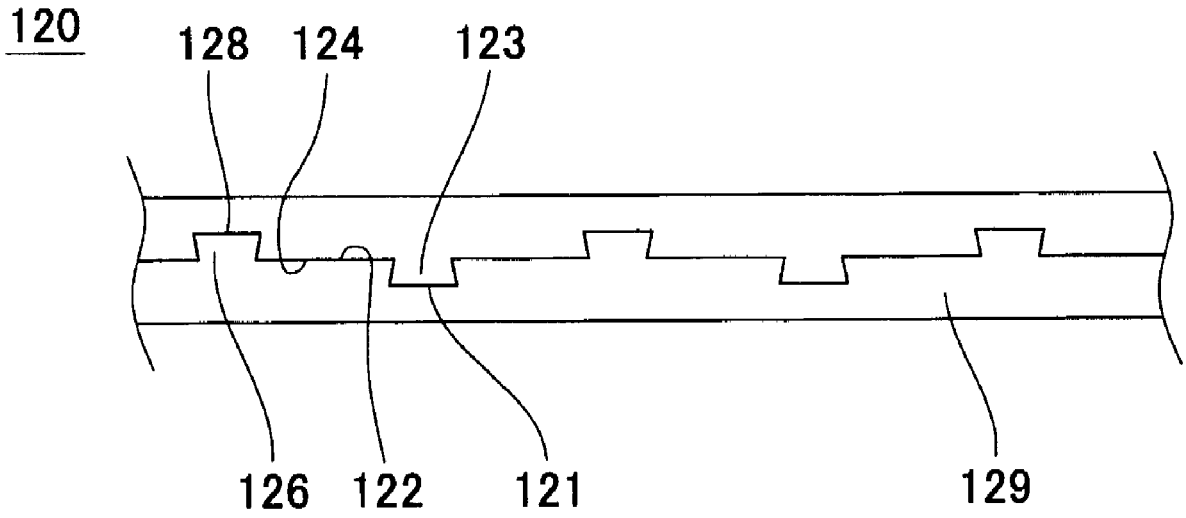
FIG. 12 illustrates the bonding portion of a cylindrical rod 120 relating to another embodiment.

FIG. 12 illustrates a cylindrical rod 120 relating to an embodiment which addresses the above-mentioned horizontal curve or a horizontal component of the curve. As illustrated in FIG. 12, convex portions 126 and 123 and concave portions 128 and 121 are formed at equal intervals alternately on edges 122 and 124 of sheet metal 129 which is used to form the cylindrical rod 120 according to the present embodiment. With such a configuration, the sheet metal 129 has a longer developed length. At the same time, the sheet metal 129 has a symmetrical shape in terms of the direction along the shorter sides of the sheet metal 129. Therefore, the bending process can be performed with high accuracy. Furthermore, since the stresses occurring between the fitted convex portion 126 and concave portion 128 and between the fitted convex portion 123 and concave portion 121 are dispersed in a symmetrical manner, the horizontal curve of the cylindrical rod 120 can be reduced.

Figure 13:
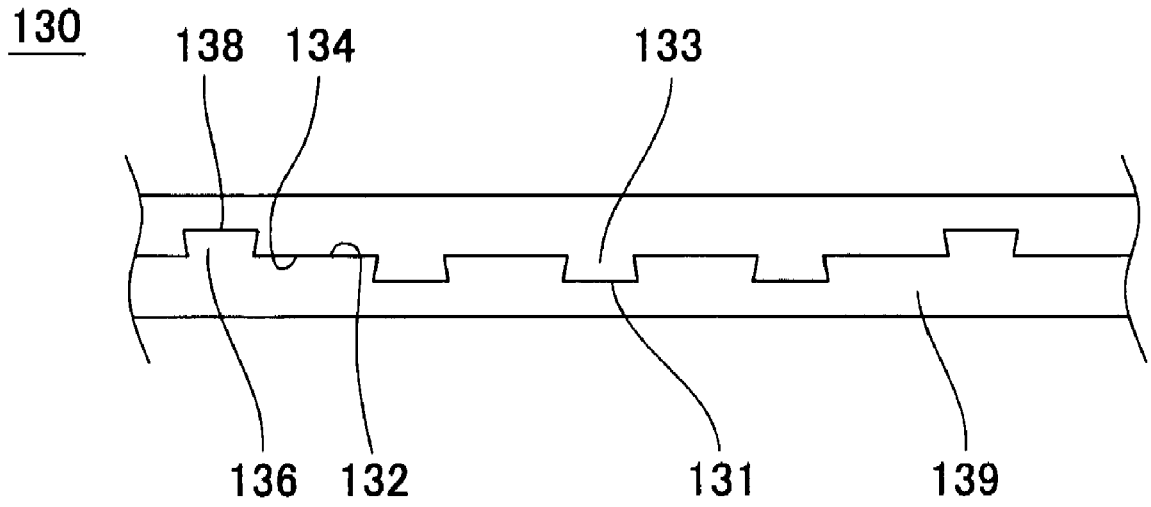
FIG. 13 illustrates the bonding portion of a cylindrical rod 130 relating to another embodiment.

FIG. 13 illustrates a cylindrical rod 130 relating to another embodiment which also addresses the horizontal curve. As illustrated in FIG. 13, the numbers of convex portions 136 and concave portions 131 formed on an edge 134 of sheet metal 139 are respectively different from the numbers of convex portions 133 and concave portions 138 formed on an edge 132 of the sheet metal 139, according to the present embodiment. This configuration is effective when the above-described curve of the cylindrical rod 130 is insignificant at the respective ends of the cylindrical rod 130 in the longitudinal direction, and significant in the middle portion. As a result, the configuration relating to the present embodiment can solve the problem of curve when the material for and the configuration of the cylindrical rod 130 is such that complex vertical curve is generated.

Figure 14:
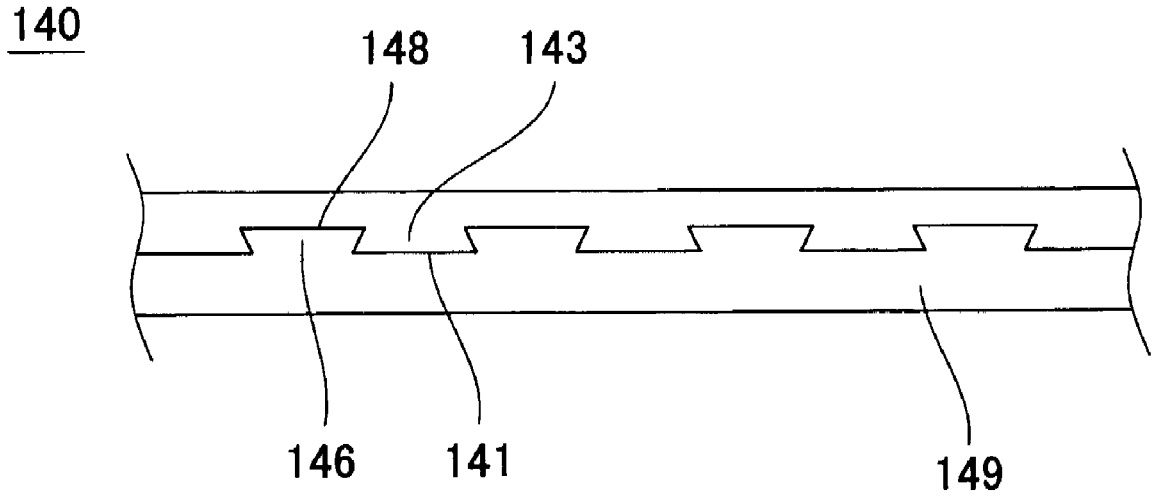
FIG. 14 illustrates the bonding portion of a cylindrical rod 140 relating to another embodiment.

FIG. 14 illustrates a cylindrical rod 140 relating to another embodiment which addresses the horizontal curve. As illustrated in FIG. 14, the spaces formed between convex portions 143 are used as concave portions 148, and the spaces between convex portions 146 are used as concave portions 141 on the edges of sheet metal 149 in the cylindrical rod 140. Therefore, the edges have shapes symmetrical to each other. As a result, the horizontal curve is prevented from occurring.

Figure 15:
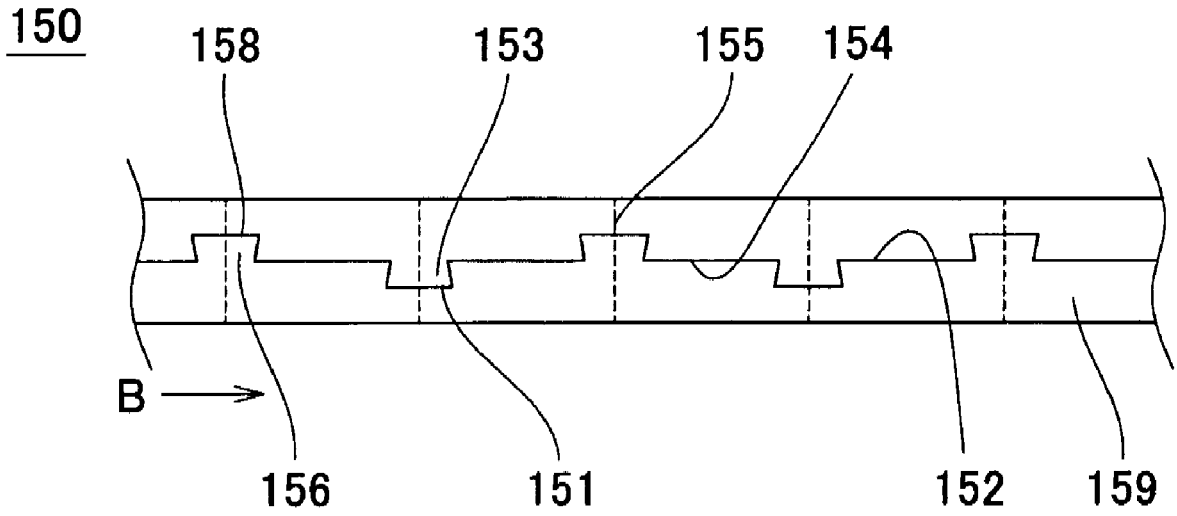
FIG. 15 illustrates how notches 155 are arranged in a cylindrical rod 150 relating to another embodiment.

FIG. 15 illustrates a cylindrical rod 150 relating to an embodiment which addresses the above-mentioned vertical curve or a vertical component of the curve. As illustrated in FIG. 15, the cylindrical rod 150 relating to the present embodiment is configured similarly to the cylindrical rod 120 illustrated in FIG. 12. In detail, convex portions 156 and concave portions 151 are alternately provided on an edge 154 of sheet metal 159, and convex portions 153 and concave portions 158 are alternately provided on an edge 152 of the sheet metal 159. In addition, the convex portions 156 and 153 are provided alternately on the edges 154 and 152, and the concave portions 151 and 158 are provided alternately on the edges 154 and 152. Furthermore, the cylindrical rod 150 has notches 155 formed at the positions at which the convex portions 153 and 156 and the concave portions 158 and 151 are respectively located. The notches 155 are formed on the internal side of the sheet metal 159 which forms the cylindrical rod 150 in such a manner as to reduce the thickness of the sheet metal 159, and extend in the direction along the circumference of the sheet metal 159.

Figure 16:
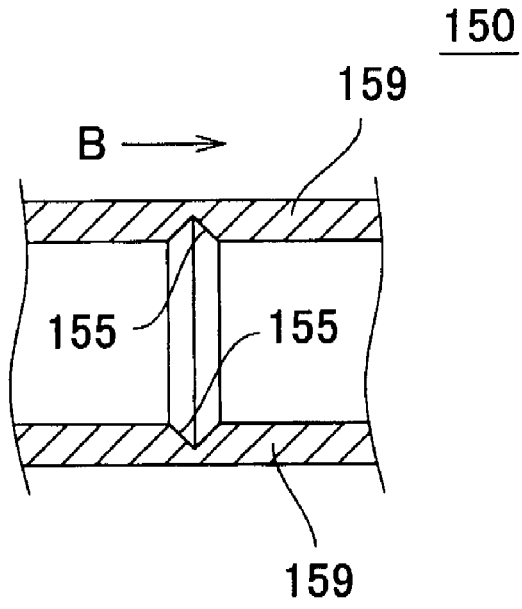
FIG. 16 illustrates the cross-section of the cylindrical rod 150 illustrated in FIG. 15 along the arrow line B.

FIG. 16 illustrates the cross-section of the cylindrical rod 150 illustrated in FIG. 15 along the arrow line B. As illustrated in FIG. 16, the notches 155 are grooves formed in the sheet metal 159 which forms the cylindrical rod 150. When formed at such positions, the notches 155 lower the rigidity of the sheet metal 159. Such a configuration alleviates the influence of the stresses created in the axis direction by the fitted convex portions 156 and concave portions 158 and the fitted convex portions 153 and concave portions 151. As a result, the vertical curve of the cylindrical rod 150 can be reduced.

In the above-described embodiment, the notches 155 are formed on the internal surface of the cylindrical rod 150 considering the circularity of the circumference of the cylindrical rod 150. However, the notches 155 may be formed on the external surface of the cylindrical rod 150 without a problem, depending on how the cylindrical rod 150 is to be used.

Figure 17:
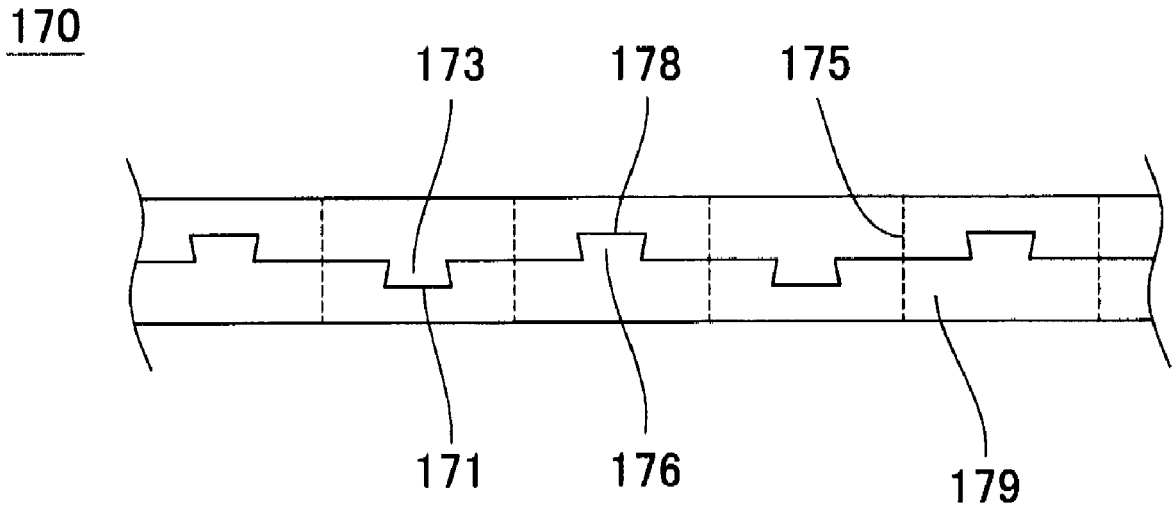
FIG. 17 illustrates how notches 175 are arranged in a cylindrical rod 170 relating to another embodiment.

FIG. 17 illustrates how notches 175 are arranged on a cylindrical rod 170 relating to another embodiment which also addresses the vertical curve. As illustrated in FIG. 17, similarly to the embodiment illustrated in FIG. 15, convex portions 176 and 173 and concave portions 178 and 171 are arranged in the cylindrical rod 170 in the same manner as in the embodiment illustrated in FIG. 12. Differently from the embodiment illustrated in FIG. 15, however, the notches 175 are positioned between the convex portions 176 and 173 or between the concave portions 178 and 171. This configuration also alleviates the influence of the stresses extending at the bonding portion in the axis direction. As a result, the vertical curve can be reduced.

Figure 18:
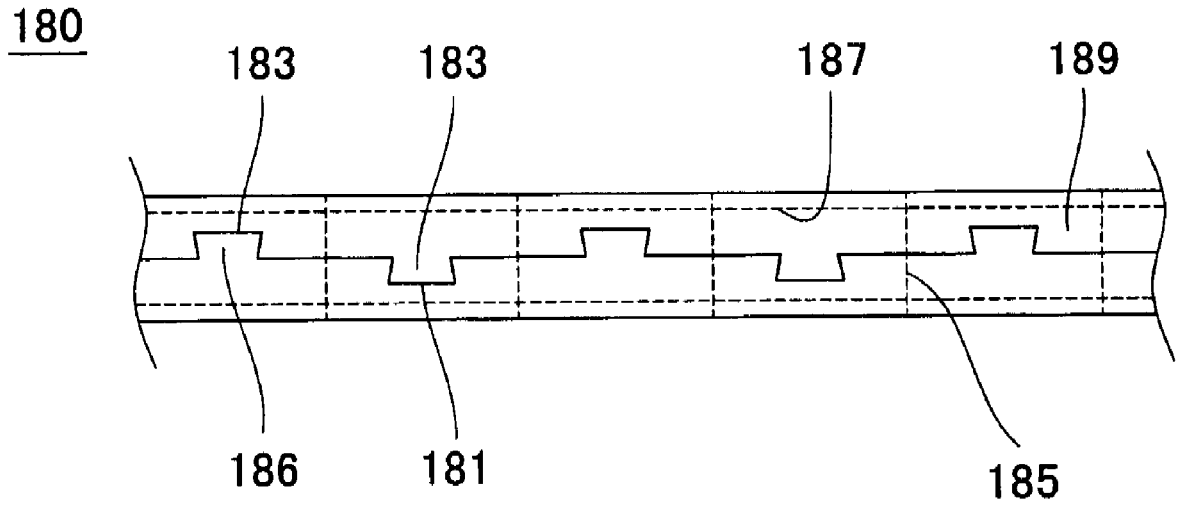
FIG. 18 illustrates how notches 185 and 187 are arranged in a cylindrical rod 180 relating to another embodiment.

FIG. 18 illustrates how notches 185 and 187 are arranged in a cylindrical rod 180 relating to another embodiment. As illustrated in FIG. 18, convex portions 186 and 183, concave portions 188 and 181, and the notches 185 extending in the direction along the circumference are arranged in the cylindrical rod 180 in the same manner as the corresponding constituents in the cylindrical rod 170 illustrated in FIG. 17. Also, these constituents achieve the same effects as the corresponding constituents of the cylindrical rod 170. According to the present embodiment, however, a plurality of notches 187 are additionally provided so as to extend in the axial direction of the cylindrical rod 180.

Figure 19:
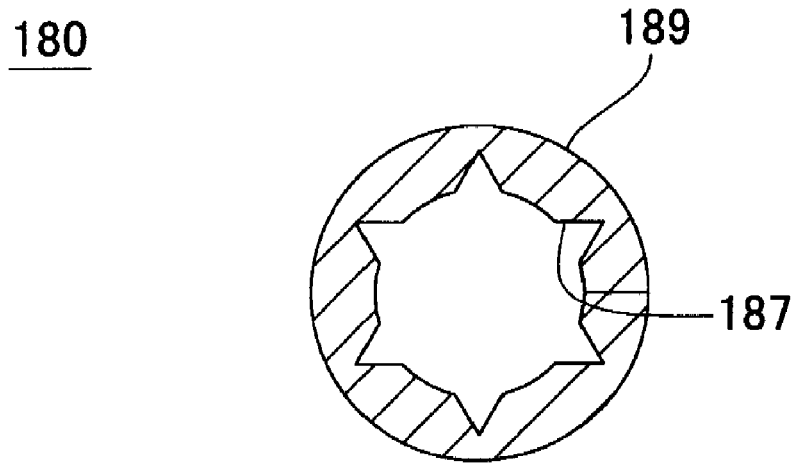
FIG. 19 is a cross-sectional view illustrating the cylindrical rod 180 illustrated in FIG. 18.

FIG. 19 illustrates a cross-section obtained by cutting the cylindrical rod 180 illustrated in FIG. 18 along a plane perpendicular to the longitudinal direction. As illustrated in FIG. 19, the notches 187 are formed on the internal surface of the cylindrical rod 180 at equal intervals. The notches 187 are also formed in order to reduce the thickness of the sheet metal 189, similarly to the notches 185. To be more specific, the notches 187 are provided so as to alleviate the influence of the stresses created in the direction along the circumference of the sheet metal 189. With this configuration, the present embodiment achieves the effect of maintaining the high circularity of the cylindrical rod 180. Note that the cylindrical rods 150, 170 and 180 illustrated in FIGS. 15 to 19 can be manufactured, for example, by using as the raw material sheet metal in which notches are formed in advance.

Figure 20:
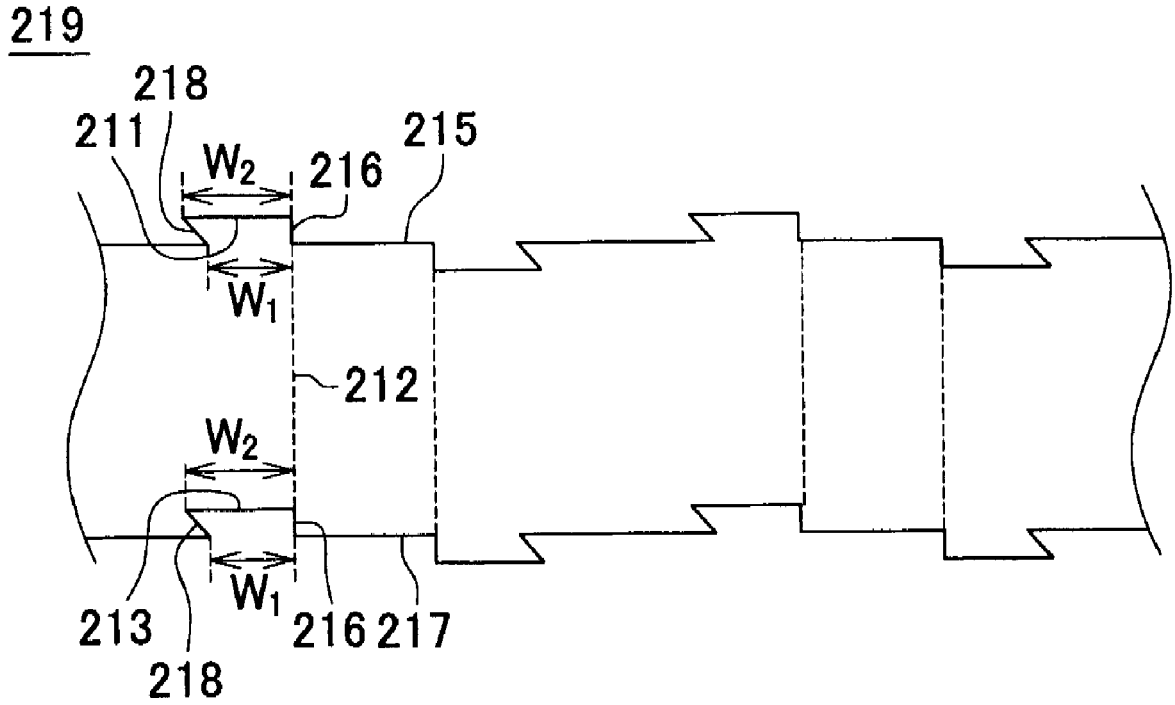
FIG. 20 illustrates the shape of sheet metal 219 relating to another embodiment.

FIG. 20 illustrates the shape of sheet metal 219 which is used as the raw material to form a cylindrical rod 210 relating to another embodiment. Similarly to the sheet metal 10 illustrated in FIG. 1, the sheet metal 219 also has a rectangular shape as a whole. In FIG. 20, however, only part of the sheet metal 219 is shown, in the enlarged state, for the purpose of showing more clearly the shapes of convex portions 211 and concave portions 213.

As illustrated in FIG. 20, the convex portions 211 and concave portions 213 are alternately provided on each of the edges 215 and 217 of the sheet metal 219. Here, the convex portions 211 and concave portions 213 have shapes complementary to each other. In addition, the convex portions 211 and concave portions 213 on the edge 215 are formed at the positions opposing, with respect to the longitudinal direction of the sheet metal 219, the positions of the concave portions 213 and convex portions 211 formed on the edge 217, as indicated by the dotted lines in FIG. 20.

At the side which is positioned on the edges 215 and 217, the convex portions 211 and concave portions 213 have a width $W_1$. However, the convex portions 211 and concave portions 213 have a width $W_2$, which is larger than the width $W_1$, at the other side which is positioned further away from the edges 215 and 217. It should be noted that the convex portions 211 and concave portions 213 each have a pair of side edges which are adjacent to the edges 215 and 217. One of the side edges forming the pair is a straight side edge 216 which forms a right angle with respect to the edge 215 or 217, and the other is a slant side edge 218 which forms an acute angle with respect to the edge 215 or 217. Referring to the positions of the straight side edges 216 of the convex portions 211 and concave portions 213 on each of the edges 215 and 217 in the present embodiment, the straight side edges 216 of the convex portions 211 are formed on one of the sides of the convex portions 211, and the straight side edges 216 of the concave portions 213 are formed on the other side of the concave portions 213 in terms of the longitudinal direction of the sheet metal 219.

Figure 21:
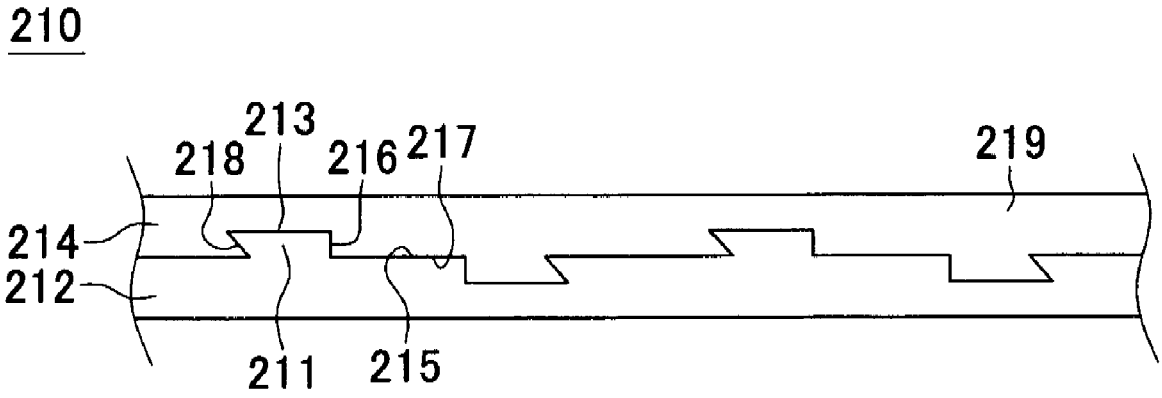
FIG. 21 illustrates, in the enlarged state, part of the bonding portion of a cylindrical rod 210 which is manufactured by bending the sheet metal 219.

FIG. 21 illustrates, in the enlarged state, part of the bonding portion of the cylindrical rod 210 which is manufactured by bending the sheet metal 219 illustrated in FIG. 20. The constituents of the cylindrical rod 210 which are already mentioned with reference to FIG. 20 are assigned the same reference numerals and not repeatedly explained.

As illustrated in FIG. 21, the convex portions 211 and concave portions 213 are fitted to each other at the portion of the cylindrical rod 210 where the edges 215 and 217 are bonded to each other. Here, both of the convex portions 211 and concave portions 213 are shaped such that the width is larger at the side thereof which is positioned further away from the edges 215 and 217 than at the side thereof on the edges 215 and 217. Therefore, even when the spring back of the sheet metal 219 is generated, the fitted convex portions 211 and concave portions 213 keeps the edges 215 and 217 bonded to each other.

Here, the straight side edges 216 of the convex portions 211 and concave portions 213 oppose each other in the longitudinal direction. When the cylindrical rod 210 is influenced by a stress which twists the cylindrical rod 210, an upper bonding portion 212 and a lower bonding portion 214 of the sheet metal 219, which are defined in the bonded portion illustrated in FIG. 21, are likely to be displaced in different directions which oppose each other in the longitudinal direction of the cylindrical rod 210. According to the cylindrical rod 210, however, the straight side edges 216 form a right angle with respect to the directions of the displacement, and are in contact with each other. This configuration prevents the displacement. Since the straight side edges 216 can be formed more accurately than the slant side edges 218, the straight side edges 216 have a small interval therebetween. For this reason, the cylindrical rod 210 has high torsional rigidity.

Figure 22:
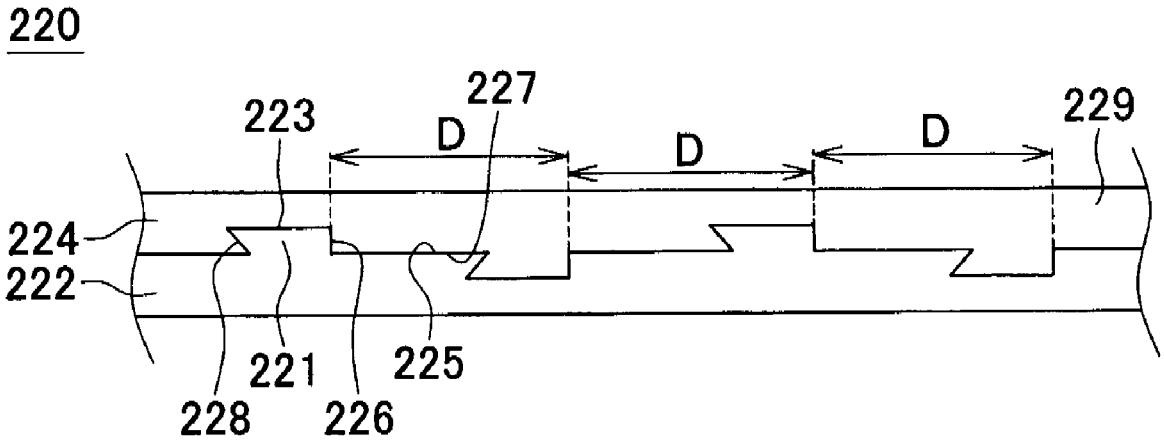
FIG. 22 illustrates, in the enlarged state, part of the bonding portion of a cylindrical rod 220 relating to another embodiment.

FIG. 22 illustrates, in the enlarged state, part of the bonded portion of a cylindrical rod 220 relating to another embodiment. As illustrated in FIG. 22, convex portions 221 and concave portions 223 formed in sheet metal 229 which constitutes the cylindrical rod 220 respectively have the same shapes as the corresponding constituents of the cylindrical rod 210 illustrated in FIG. 21. In the cylindrical rod 220, however, the straight side edges 216 of all the convex portions 221 and concave portions 223 are formed on the right side in the drawing. Therefore, the convex portions 221 and concave portions 223 are arranged at equal internals (the interval D), and, at the same time, the straight side edges 216 are arranged at equal intervals (the internal D) in the longitudinal direction of the cylindrical rod 220. As a result, the cylindrical rod 220 uniformly has high torsional rigidity in the longitudinal direction thereof.

As described above in detail, the present invention can provide a cylindrical rod which is manufactured by bending sheet metal and has high circularity and linearity. The cylindrical rod relating to the present invention can be used in place of a solid metal round bar member. Therefore, the present invention can reduce the raw material cost for many machines and tools which have been forced to use the solid members which are manufactured by the cutting technique due to the issues relating to the accuracy. In addition, since the cylindrical rod relating to the present invention is lighter than the solid members, the present invention can reduce the friction loss of machines during the operation as well as the weight of the machines.

While the aspects of the present invention have been described through embodiments, the technical scope of the invention is not limited to the above described embodiments. It is apparent to persons skilled in the art that various alternations and improvements can be added to the above-described embodiments. It is also apparent from the scope of the claims that the embodiments added with such alternations or improvements can be included in the technical scope of the invention.

The invention claimed is:

1. A cylindrical rod which is formed by bonding together a pair of opposing edges of sheet metal, wherein:

each of the opposing edges has (i) convex portions each of which protrudes from the edge and includes a sub-portion whose width is larger at a side thereof more distant from the edge than at a side thereof less distant from the edge, and (ii) concave portions each of which recedes from the edge and includes a sub-portion whose width is larger at a side thereof more distant from the edge than at a side thereof less distant from the edge, the convex portions and the concave portions of one of the opposing edges are fitted into the concave portions and the convex portions of the other of the opposing edges, a periphery of each of the convex and concave portions has a linear section which forms substantially a right angle with respect to a corresponding one of the opposing edges and extends from the corresponding one of the opposing edges to a part of the respective convex or concave portion most distant from the corresponding one of the opposing edges, and a slant section which forms an acute angle with respect to the corresponding one of the opposing edges and extends from the corresponding one of the opposing edges to a part of the respective convex or concave portion most distant from the corresponding one of the opposing edges, the linear section and the slant section being on opposite sides of the each of the convex and concave portions in a direction parallel to the corresponding one of the opposing edges, and both the linear section and the slant section being adjacent to the corresponding one of the opposing edges.

2. The cylindrical rod as set forth in claim 1, wherein the linear sections are arranged at equal intervals in a longitudinal direction of the cylindrical rod.

3. The cylindrical rod as set forth in claim 2, wherein the linear section is formed on the same side in each of the convex and concave portions in the longitudinal direction of the cylindrical rod.

4. The cylindrical rod as set forth in claim 1, wherein the linear section is formed on the same side in each of the convex and concave portions in a longitudinal direction of the cylindrical rod.

5. The cylindrical rod as set forth in claim 1, wherein a plurality of notches which extend in a direction along a circumference of the cylindrical rod are provided so as to be adjacent to each other in an axis direction.

6. The cylindrical rod as set forth in claim 5, wherein the plurality of notches are positioned at the convex and concave portions.

7. The cylindrical rod as set forth in claim 5, wherein the plurality of notches are positioned between the convex and concave portions in the axis direction.

8. The cylindrical rod as set forth in claim 5, wherein a plurality of notches which extend in the axis direction are additionally provided so as to be adjacent to each other in the direction along the circumference of the cylindrical rod.

9. The cylindrical rod as set forth in claim 1, wherein the linear section of each of the convex portions is on a same side of the convex portion in a direction parallel to the corresponding one of the opposing edges, and the linear section of each of the concave portions is on a same side of the concave portion in a direction parallel to the corresponding one of the opposing edges.

10. The cylindrical rod as set forth in claim 1, wherein the linear section of each of the convex portions of one of the opposing edges and the linear section of each of the convex portions of the other of the opposing edges are on opposite sides of their respective convex portions in a direction parallel to the one of the opposing edges, and the linear section of each of the concave portions of one of the opposing edges and the linear section of each of the concave portions of the other of the opposing edges are on opposite sides of their respective concave portions in a direction parallel to the one of the opposing edges.

11. A cylindrical rod which is formed by bonding together a pair of opposing edges of sheet metal, wherein:

each of the opposing edges has (i) convex portions, each of which protrudes from the edge and includes a sub-portion whose width is larger at a side thereof more distant from the edge than at a side thereof less distant from the edge, and (ii) concave portions, each of which recedes from the edge and includes a sub-portion whose width is larger at a side thereof more distant from the edge than at a side thereof less distant from the edge, the convex portions and the concave portions of one of the opposing edges are fitted into the concave portions and the convex portions of the other of the opposing edges, respectively, and the shape of each of the convex portions and concave portions is a right trapezoid with exactly two right angles.

* * * * *